US005327650A

United States Patent [19]

Rojas

[11] Patent Number: 5,327,650

[45] Date of Patent: Jul. 12, 1994

[54] KNIFE, FORK AND SPOON COMBINATION

[76] Inventor: Gilbert R. Rojas, P.O. Box 124-1100 Tibas, San Jose, Costa Rica

[21] Appl. No.: 136,357

[22] Filed: Oct. 14, 1993

[51] Int. Cl.[5] ..... A47J 43/28

[52] U.S. Cl. ..... 30/147; D7/643

[58] Field of Search ..... 30/147-150, 30/322, 324; D7/643, 645

[56] References Cited

U.S. PATENT DOCUMENTS 1,053,387 2/1913 Hawley ..... 30/147

FOREIGN PATENT DOCUMENTS 43508 8/1910 Austria ..... 30/147

19235 of 1913 United Kingdom ..... 30/147

*Primary Examiner*—Richard K. Seidel

*Assistant Examiner*—Hwei-Siu Payer

*Attorney, Agent, or Firm*—Joseph C. Mason, Jr.; Ronald E. Smith

[57] ABSTRACT

A knife has a handle that slideably receives the respective handles of a fork and a spoon in one orientation only. The transverse cross section of the fork handle and the spoon handle is generally rectangular, with a longitudinally-extending step formed in each side to create a broad base and a slightly narrower upper part. The knife handle has a corresponding channel on each of its opposite sides and slidingly receives the fork handle on one side and the spoon handle on the other if the handles are correctly oriented. The steps formed in the handles of the fork and spoon are of small depth so that they are barely noticeable by users of those utensils.

3 Claims, 2 Drawing Sheets

KNIFE, FORK AND SPOON COMBINATION

BACKGROUND OF THE INVENTION

1. Field of the invention

This invention relates, generally, to eating utensils that are interconnected to one another for convenience.

2. Description of the Prior Art

Inventors have developed numerous designs that enable the interconnection of knives, forks, spoons, corkscrews, can openers, and the like. For example, see U.S. Pat. Nos. 284,442, 318,600, 937,613, 1,178,122, 2,470,492, 4,524,512, and 4,995,154. These designs have utility because they minimize the probability of losing an important utensil by ensuring that all needed utensils will be together at one location. This facilitates packing for picnics and the like.

If too many items are joined in combination, however, the bulk of the combination utensil renders it unwieldy and unsuitable for use. Thus, the most popular combination utensil item is the combination knife, fork, and spoon. Since the distal end of a spoon or fork is arcuate in configuration, the design of a combination knife, fork, and spoon is somewhat problematical. Some designs are difficult to use because it is difficult to reassemble the utensils after thay have been separated for use; some are not even easy to disassemble. Thus, they may be reassembled incorrectly after use. Others are expensive to fabricate and may also use large amounts of materials because of their design peculiarities. Thus, despite the differing approaches shown in the above-identified patents, an optimal design that is easy to assemble and disassemble, which saves materials, and which is inexpensive to make, has long eluded inventors.

Significantly, when the prior art is considered as a whole, it neither teaches nor suggests to those of ordinary skill in this art how an optimal design could be achieved.

SUMMARY OF THE INVENTION

The longstanding but heretofore unfulfilled need for a combination utensil including a knife, fork, and spoon that is easy to assemble and disassemble, and which has an elegant design to reduce materials and enable facile construction thereof is now provided by a construction that includes a knife having a handle that slideably receives the respective handles of a fork and spoon but which is uniquely configured to slidingly accept said respective handles only when they are oriented in a predetermined position. This enables facile assembly of the device, yet ensures that it will always be reassembled properly. The design is created in a mold so that a minimum of materials are used, and the resulting item is manufactured at a very low cost so that it is easily affordable by consumers.

It should therefore be clear that the primary object of this invention is to provide a combination knife, fork, and spoon of elegant design that overcomes all of the limitations of the prior art designs.

A more specific object is to provide a combination utensil that includes means that ensures that it will always be reassembled correctly.

These and other important objects, features and advantages of the invention will become apparent as this description proceeds.

The invention accordingly comprises the features of construction, combination of elements and arangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
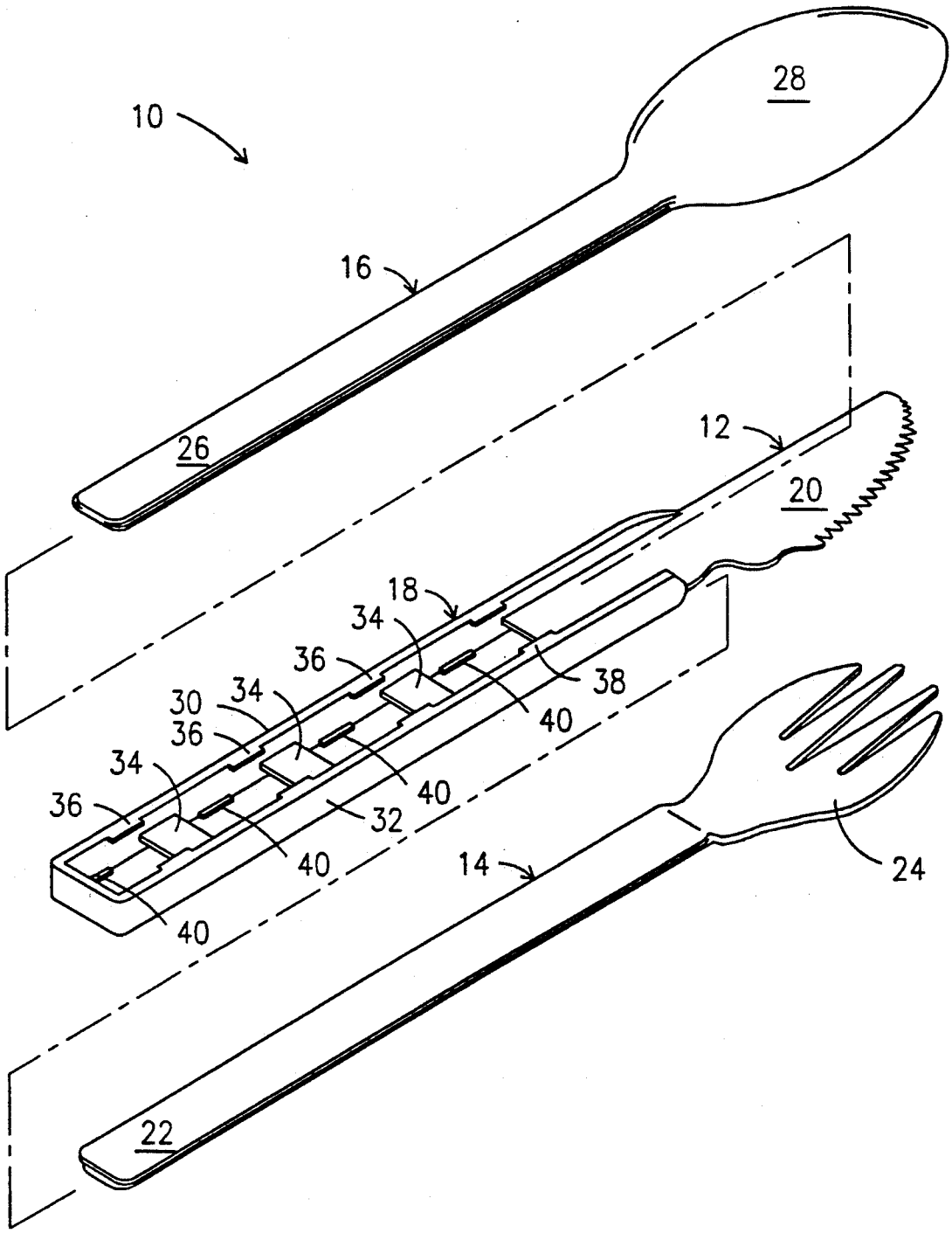
FIG. 1 is an exploded perspective view of the novel combination utensil.

Referring now to FIG. 1, it will there be seen that an illustrative embodiment of the present invention is denoted as a whole by the reference numeral 10. Combination utensil 10 includes, generally, knife 12, fork 14, and spoon 16.

More particularly, knife 12 includes handle 18 and blade 20. Similarly, fork 12 includes handle 22 and tines 24 and spoon 16 includes handle 26 and dished part 28.

Figure 2:
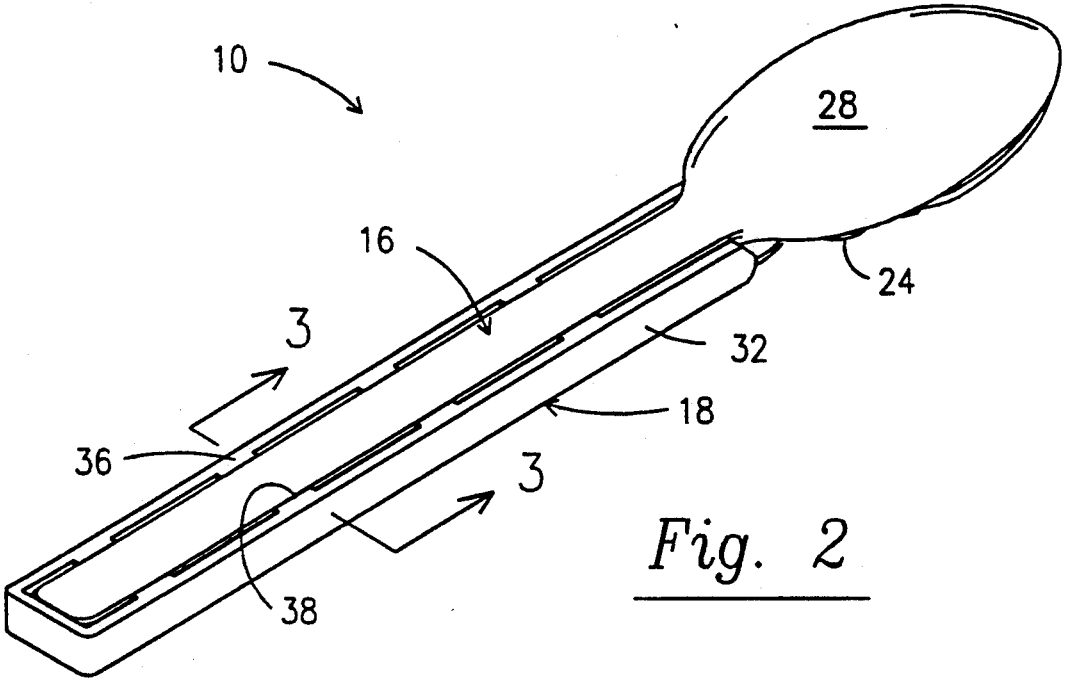
FIG. 2 is a perspective view of the novel combination utensil in its assembled configuration.

FIG. 2 depicts the combination utensil of this invention when the knife, fork, and spoon are in their assembled configuration.

The key to this invention resides in the dual channel-forming cross-sectional configuration of knife handle 18, and the complemental cross-sectional configuration of the respective handles of the fork and spoon. More particularly, the respective cross-sectional configurations are such that the fork and spoon may be slideably received in one orientation only within the channels defined by the knife handle.

Figure 3:
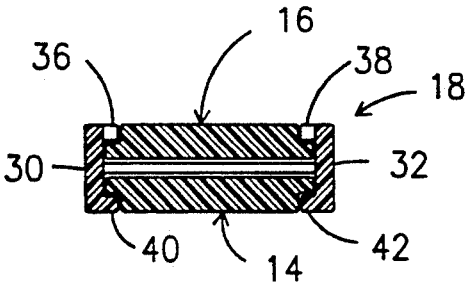
FIG. 3 is a transverse sectional view taken along line 3—3 in FIG. 1.
Figure 5:
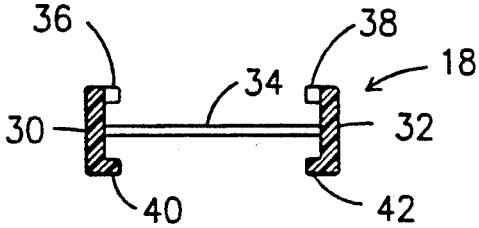
FIG. 5 is a transverse sectional view of the knife handle alone.

As shown in FIG. 3, the construction of the first and second channels of the knife handle are mirror images of each other. More particularly, handle 18 of knife 16 includes a pair of elongate, parallel side walls 30, 32 that are interconnected to one another at equidistantly and longitudinally spaced intervals by a plurality of interconnecting walls that are collectively denoted 34 in FIG. 1 and which are also shown in FIGS. 3 and 5; the interconnecting walls are disposed normal to the plane of the side walls. Significantly, interconnecting walls 34 vertically bisect side walls 30, 32, i.e., said walls 34 divide the knife handle into a fork handle-receiving channel and a spoon handle-receiving channel.

Said interconnecting walls could be formed as a single, continuous interconnecting wall, but such construction would waste materials. However, such construction is clearly within the scope of this invention.

Note in FIG. 1 that knife blade 20 is coplanar with the interconnecting walls and is integrally formed with side walls 30, 32.

As perhaps best depicted in FIGS. 1 and 2, a first plurality of retainer members 36, 38 is formed at equidistantly and longitudinally spaced intervals along the extent of each side wall 32, 34 at first outermost edges thereof, and a second plurality 40, 42 of said retainer members is formed at said intervals along the opposite outermost edges of said side walls. Said retainers bar entrance of the respective fork and spoon handles into the handle-receiving channel of the knife handle when said utensils are inverted from their respective storage positions, as should be clear from FIGS. 1 and 3. The retainers also retain the fork or spoon handles within their respective channels when said utensils are properly oriented as depicted in FIGS. 2 and 3.

Figure 4:
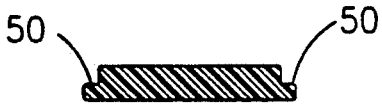
FIG. 4 is a transverse sectional of a fork or spoon handle.

The construction of the fork and spoon handles is such that said handles are slideably received within the channels defined by the knife handle when properly oriented with respect thereto. More particularly, each handle is initially of solid parallelepiped construction; an elongate step 50 is then formed therein along the opposite edges thereof as depicted in FIG. 4. The part of the fork or spoon handle that is narrowed by the formation of the steps therein will hereinafter be referred to as the narrow part of the fork or spoon handle, and the part having no steps formed therein, i.e., the lower part as depicted in FIG. 4, will be referred to as the broad base.

Significantly, the depth and transverse extent of the steps 50 formed in the fork and spoon handles is nominal and thus is hardly felt by users of the novel forks and spoons. Specifically, the depth of each step 50 is slightly greater than the thickness of said retainers 36, 38, 40, 42, and the transverse extent of each groove is slightly greater than the transverse extent of said retainers. Thus, each step 50 may be thought of as a keyway and the retainers may be thought of as keys; the respective handles of the fork and spoon can enter the handle-receiving channels of the knife handle only if said handles are properly oriented to allow mating of the keys and keyways.

When a user attempts to reassemble the novel knife, fork, and spoon combination after they have been used and cleaned, retainers 36 and 38, or 40 and 42, will bar the broad base of the handle of the fork or spoon from entering the outer part of the associated channel; this indicates to the user that the utensil must be inverted before reassembly can be accomplished.

On the other hand, when the fork or spoon handle is properly oriented, the steps formed in the handle accommodate the retainers that protrude into the outer part of each handle-receiving channel and the broad base of the handle slides thereunder, i.e., into the inner part of the channel. Thus, the thickness of the knife handle defines the thickness of the entire handle assembly.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A combination of knife, fork, and spoon assembly, comprising:

a knife having a handle and a blade;

a fork having a handle and a set of tines;

a spoon having a handle and a dished distal end;

said knife handle including a fork handle-receiving channel and a spoon handle-receiving channel, said channels sharing a common construction;

said knife handle including a pair of elongate, transversely spaced apart, parallel side walls, each of said side walls having a first outermost edge and a second, opposite outermost edge;

said knife handle further including at least one interconnecting wall disposed in interconnecting relation to said side walls, said at least one interconnecting wall being disposed in a plane normal to the plane of said side walls;

said at least one interconnecting wall disposed in bisecting relation to said side walls, thereby dividing said knife handle into said fork handle-receiving channel and said spoon handle-receiving channel;

each of said handle-receiving channels having an inner part and an outer part;

a plurality of retainers being formed at longitudinally spaced apart intervals along the extent of each of said pair of side walls, said plurality of retainers being disposed on said first and second outermost edges of said side walls and extending toward one another in a plane parallel to the plane of said at least one interconnecting wall;

said outer part of each of said handle-receiving channels having a transverse extent less than a transverse extent of the inner part of each of said handle-receiving channels, due to placement of said plurality of retainers on said first and second outermost edges of said side walls;

an elongate step being formed on opposite edges of said fork handle, said elongate step dividing said fork handle into a broad base having a first transverse extent and a narrow upper part having a second transverse extent less than said first transverse extent;

an elongate step being formed on opposite edges of said spoon handle, said elongate step dividing said spoon handle into a broad base having a first transverse extent and a narrow upper part having a second transverse extent less than said first transverse extent;

said fork handle being selectively slideably received within said fork handle-receiving channel when said broad base of said fork is in alignment with the inner part of said fork handle-receiving channel and when the narrow upper part of said fork is in alignment with the outer part of said fork, handle-receiving channel; and said spoon handle being selectively slideably received within a said spoon handle-receiving channel when said broad base of said spoon is in alignment with the inner part of said spoon handle-receiving channel and when the narrow upper part of said spoon is in alignment with the outer part of said spoon, handle-receiving channel.

2. The assembly of claim 1, wherein each of said plurality of retainers has a common thickness and a common extent slightly less than the corresponding depth and extent of said steps formed in said respective fork and spoon handles.

3. The assembly of claim 2, wherein a combined thickness of the knife, fork, and spoon handle when the respective handles of the fork and spoon are slideably received within their associated handle-receiving channels is equal to a predetermined thickness of the knife handle.

* * * * *